US009176469B2

(12) United States Patent
Facchini, II et al.

(10) Patent No.: US 9,176,469 B2
(45) Date of Patent: Nov. 3, 2015

(54) SYSTEMS AND METHODS FOR IMPLEMENTING A SCHEME FOR COOLING, AND MINIMIZING CURL IN, OUTPUT IMAGE RECEIVING MEDIA SUBSTRATES IN IMAGE FORMING DEVICES

(71) Applicant: XEROX Corporation, Norwalk, CT (US)

(72) Inventors: Charles T. Facchini, II, Webster, NY (US); Paul M. Fromm, Rochester, NY (US); Steven M. Russel, Bloomfield, NY (US); Erwin Ruiz, Rochester, NY (US); David S. Derleth, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 22 days.

(21) Appl. No.: 14/170,351

(22) Filed: Jan. 31, 2014

(65) Prior Publication Data

US 2015/0220052 A1 Aug. 6, 2015

(51) Int. Cl.

| | |
|---|---|
| ***G03G 15/00*** | (2006.01) |
| ***G03G 21/00*** | (2006.01) |
| ***B65H 23/34*** | (2006.01) |
| ***B65H 29/70*** | (2006.01) |
| ***G03G 21/20*** | (2006.01) |

(52) U.S. Cl.
CPC ..... *G03G 21/20* (2013.01)

(58) Field of Classification Search
CPC ..... G03G 15/00; G03G 21/00; G03G 21/20; B65H 23/34; B65H 29/70
USPC ..... 399/16, 21, 261, 381, 405, 406, 407
See application file for complete search history.

(56) References Cited

U.S. PATENT DOCUMENTS

| | | | | | |
|---|---|---|---|---|---|
| 5,089,857 | A * | 2/1992 | Xydias | ..... | 399/401 |
| 5,287,157 | A * | 2/1994 | Miyazato et al. | ..... | 399/406 |
| 5,947,467 | A * | 9/1999 | Billings et al. | ..... | 271/188 |
| 2003/0044208 | A1 * | 3/2003 | Kouno | ..... | 399/406 |
| 2007/0110490 | A1 * | 5/2007 | Tateishi | ..... | 399/406 |
| 2011/0142517 | A1 * | 6/2011 | Kanai et al. | ..... | 399/406 |
| 2011/0318078 | A1 * | 12/2011 | Aoi | ..... | 399/381 |

FOREIGN PATENT DOCUMENTS

| | | | | | |
|---|---|---|---|---|---|
| JP | 01266558 | A * | 10/1989 | ..... | G03G 15/20 |
| JP | 07219366 | A * | 8/1995 | ..... | G03G 15/20 |
| JP | 09025041 | A * | 1/1997 | ..... | G03G 15/00 |
| JP | 11015308 | A * | 1/1999 | ..... | G03G 15/20 |
| JP | 2004145160 | A * | 5/2004 | ..... | G03G 15/00 |
| JP | 2005089079 | A * | 4/2005 | ..... | B65H 29/70 |
| JP | 2005234205 | A * | 9/2005 | ..... | G03G 15/00 |
| JP | 2007022756 | A * | 2/2007 | ..... | B65H 29/70 |
| JP | 2007119109 | A * | 5/2007 | ..... | B65H 29/70 |
| JP | 2009007079 | A * | 1/2009 | ..... | G03G 15/00 |
| JP | 2010145621 | A * | 7/2010 | ..... | G03G 21/20 |

* cited by examiner

*Primary Examiner* — Nguyen Ha
(74) *Attorney, Agent, or Firm* — Ronald E. Prass, Jr.; Prass LLP

(57) ABSTRACT

A system and method are provided for cooling and de-curling output image receiving media substrates prior to stacking them in output trays of office-sized image forming devices. Customer requirements are met by providing a cooling capacity with a simple module that is particularly adaptable to a standard office-sized image forming device without increasing a vertical footprint of the device. The substrate de-curling and cooling capacity is able to be retrofit on typical office-sized image forming devices as, for example, an upgraded output catch tray to provide an all stocks at rated speed capacity in the image forming device. A substrate and de-curling unit cools sheets of image receiving media substrate via conduction by pressing the sheets individually and in order to a pair of rotating cooling drums with a pair of cooperating belts supported by appropriate idler rollers in a paper path having a horizontal "S" shape.

18 Claims, 5 Drawing Sheets

SYSTEMS AND METHODS FOR IMPLEMENTING A SCHEME FOR COOLING, AND MINIMIZING CURL IN, OUTPUT IMAGE RECEIVING MEDIA SUBSTRATES IN IMAGE FORMING DEVICES

BACKGROUND

1. Field of the Disclosed Embodiments

This disclosure relates to systems and methods for cooling and de-curling output image receiving media substrates prior to stacking the output image receiving media substrates in output trays of office-sized image forming devices.

2. Related Art

Many modern image forming devices conduct increasingly sophisticated image forming operations for the production of black-and-white and color images on a broad spectrum of image receiving media substrates. These image forming operations are often customized internally by the image forming devices in an effort to optimize the production of images on the myriad image receiving media substrates. As an example, certain image forming devices are caused to operate at differing speeds for the transport of different classes of image receiving media substrates through these image forming devices in support of optimized image forming operations on these different classes of image receiving media substrates. For example, a common conventional image marking engine tasked with producing output images on image receiving media substrates may operate at a nominal speed of 70 pages per minute (ppm) for conducting most image forming operations on standard stock image receiving media substrates. The same conventional image marking engine may slow these image forming operations to half speed (or 35 ppm) on an indication that the image forming operations are to be conducted on certain "heavy" page (paper) stock image receiving media substrates, and may be further adjustable to perform to image forming operations at two thirds speed (or approximately 48 ppm) for certain "other" page (paper) stock image receiving media substrates, including what are commonly referred to in the industry as "coated" stocks. These differing speeds have the advantage of optimizing the image forming operations for the individual image receiving media substrate compositions in the image forming devices.

Customer preferences are often to desire that a particular image forming device output marked image receiving media at a constant speed. In other words, customers want image forming devices that output pages at a particular rate regardless of what occurs internally to the image forming device to make that happen. In an effort to enhance customer satisfaction, and to gain certain market advantage, image forming device manufacturers have undertaken efforts to speed up certain of the image forming operations in a manner that, in the example above, for example, all image forming operations, regardless of a constitution of the image receiving media substrates on which the images are formed by the image forming operations, everything would run at 70 ppm.

As efforts were undertaken to mode image forming devices such that an "all stocks at rated speed" or ASRS functionality could be implemented, certain disadvantageous issues arose. In cases, it was determined that, while the marking engines and fuser components could manage these speeds across many and widely varied compositions of image receiving media substrates, at least the heavy paper image forming operations experienced difficulty. This difficulty manifested itself principally in blocking of heavier paper output image receiving media substrates that would jam, not stack correctly, or stick together at outputs of the image forming devices and in output image media receptacles, including output catch trays (OCTs), associated with the image forming devices. It was determined that this difficulty arose principally because the heavy paper output image receiving media substrates, with images formed and fused thereon, are not afforded enough time to properly cool from the image forming and fusing operations at the accelerated page rates prior to being output to the output image receiving media substrate receptacles.

Additional efforts then had to be undertaken to then counter the manifested difficulties. In certain configurations, a solution was introduced that required that a cooling device (referred to, among other things, as an interface cooling module or ICM) to be added as a particularly-configured separate stand-alone component unit placed between the image marking engine and an output stacker, stapler, or other finishing device. The cooling devices were configured to include decurlers and other support mechanisms to support an upmarket requirement of ASRS in more complex image forming systems. The cooling devices were generally configured as completely separate, somewhat bulky (e.g., 18-20 inch wide) modules with wheels, cabinetry, electronics, myriad installed components, and separate power sources, specifically provided in an effort to support the customer-requested functioning. The solution turned out to be adequate for large and increasingly complex image forming systems, and for office environments where a physical footprint for a complex image forming system is comparatively unconstrained. The difficulty was that the solution, adding significant footprint, cost and noise to the image forming system, proved incompatible to implementation in many office environments.

SUMMARY OF DISCLOSED EMBODIMENTS

The large cabinet solution was configured to have a comparatively very long paper path in which the image receiving media exited the marking and fusing components at one height and after being translated through the large cabinet solution exited the large cabinet solution at another level to be manipulated by one or more common output devices such as, for example, a stapler, a stacker, or other like finishing components. In the paper path, individually-packaged components include whole plate coolers often composed of perforated plates with high-powered air movers to support the cooling function carried out by the large cabinet solution.

As indicated briefly above, having demonstrated the ASRS functionality in more complex image forming systems, individual office device customers increasingly expressed a desire to be afforded the same functionality without the necessity of increasing the physical footprint of the more compact (office-sized) image forming devices that they operated in significant numbers. In other words, these customers desired functionality without requiring separate conventional output media cooling devices that had specifically been developed to address the difficulties in more complex image forming systems. The customers wanted the ASRS functionality, but without the burden, cost or physical constraints of adding output devices, interface modules and/or additional components that would necessarily increase their systems' footprints.

For cooling and de-curling output image receiving media substrates prior to stacking the output image receiving media substrates in output trays of office-sized image forming devices. It would be advantageous then, in view of customer desires/requirements, to provide a level of a cooling capability or cooling capacity, such as is provided with the separate cooling devices described above in complex image forming systems with a simple module that is particularly adaptable to a standard image forming device in a manner to provide the substrate de-curling and cooling capacity without increasing the footprint of the image forming device with which the module is to be associated.

It would be further advantageous to provide a substrate de-curling and cooling capacity that may be able to be retrofit on typical office-sized image forming devices as, for example, an upgraded OCT.

Exemplary embodiments of the systems and methods according to this disclosure may provide a de-curling and cooling device that does not increase a footprint of an office-sized image forming device.

Exemplary embodiments may facilitate an ability of an office-sized image forming device to provide an ASRS capacity.

Exemplary embodiments may provide a de-curling and cooling unit at an output side of the office-sized image forming device in a relatively same vertical space as an output tray of the office-sized image forming device.

Exemplary embodiments may cool sheets of image receiving media substrate via conduction by pressing the sheets individually and in order to a pair of rotating cooling drums with a pair of cooperating belts supported by appropriate idler rollers. In general, a cooling and de-curling module may be configured to present a paper path having a horizontal "S" shape below an OCT.

Exemplary embodiments may provide a comparatively simple cooling device for cooling and de-curling heated output image receiving media substrates output from the office-sized image forming device. An advantage of the systems and methods according to this disclosure is to provide a cooling device that is simpler and cheaper, and that takes less space (as it fits in the space under the standard output tray in a standard office-space sized image forming device) than the much more complex and bulkier than stand-alone components that are separately manufactured for inclusion and use in complex image forming systems.

Exemplary embodiments may be configured to minimize curl in the output image receiving media substrates by placing, in order in a process direction a larger cooling drum to gently relieve curl in the relatively hotter image receiving media substrates and a smaller cooling drum to counter bend the image receiving media substrates so as to relieve any residual curl in an opposite direction when the image receiving media substrates are cooler and less pliable.

Exemplary embodiments may provide an active cooling component that flows accelerated air through the cooling and de-curling mechanism to cool the respective cooling drums by convection through a transverse or axial flow of the accelerated air through the cooling drums, substantially orthogonally to the process direction, the cooling drums in turn cooling the image receiving media substrates held in close contact to them.

Exemplary embodiments may include multiple cooling fans mounted internally with axes pointing in a manner to force air substantially radially toward the cooling drums to impinge on an inner surface of each of the cooling drums.

Exemplary embodiments may configure an internal surface of each the cooling drums with a plurality of cooling fins.

Exemplary embodiments may include a Peltier cooling device for heat dissipation in one, or both, of the cooling drums.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for cooling and de-curling output image receiving media substrates prior to stacking the output image receiving media substrates in output trays of office-sized image forming devices, will be described, in detail, with reference to the following drawings, in which.

DETAILED DESCRIPTION OF THE DISCLOSED EMBODIMENTS

The systems and methods for cooling and de-curling output image receiving media substrates prior to stacking the output image receiving media in output trays of office-sized image forming devices according to this disclosure will generally refer to this specific utility for those systems and methods. Exemplary embodiments described and depicted in this disclosure should not be interpreted (1) as being specifically limited to any particular configuration of an image forming device, or any individual module associated with an image forming device, or (2) as being directed to any particular limiting intended use. In fact, any specific manner by which to effect cooling and de-curling of image receiving media substrates in a particular system, component, configuration or technique of a limited size that may benefit from the systems and methods according to this disclosure is contemplated.

Specific reference to, for example, any particular image forming device, including but not limited to any of a printer, copier, scanner, facsimile machine or multi-function device, should be understood as being exemplary only, and not limited, in any manner, to any particular class of such devices, except insofar as the disclosed concepts are intended to be particularly adaptable to office-sized image forming devices in a manner that is specifically directed at not increasing or otherwise adversely impacting a physical footprint of the office-sized image forming devices within an office operating environment. The systems and methods according to this disclosure will be described as being particularly adaptable to use in office-sized printing and/or copying devices that produce output images according to input data and instructions that may be transmitted to a particular printing and/or copying device, but should not be considered as being limited to only these types of devices. Any commonly-known image forming device, particularly one that employs toner particles, as that term is commonly understood to those of skill in the art, as the marking material or medium for producing images on an image receiving media substrate, or that otherwise introduces heat into the image receiving media substrates as part of the image forming operation, which may be adapted according to the specific capabilities discussed in this disclosure, is contemplated.

The disclosed embodiments may advantageously configure for operation and use a particularly-adapted cooling and de-curling module that may be attached, or even retrofit, to an office-sized image forming device. The particularly-adapted cooling and de-curling module may be configured to comport to a vertical profile of the standard output image receiving media substrate tray or OCT. In this manner, the particularly-adapted cooling and de-curling module may be provided in a manner that does not increase a physical size profile of the associated image forming device.

Figure 1:
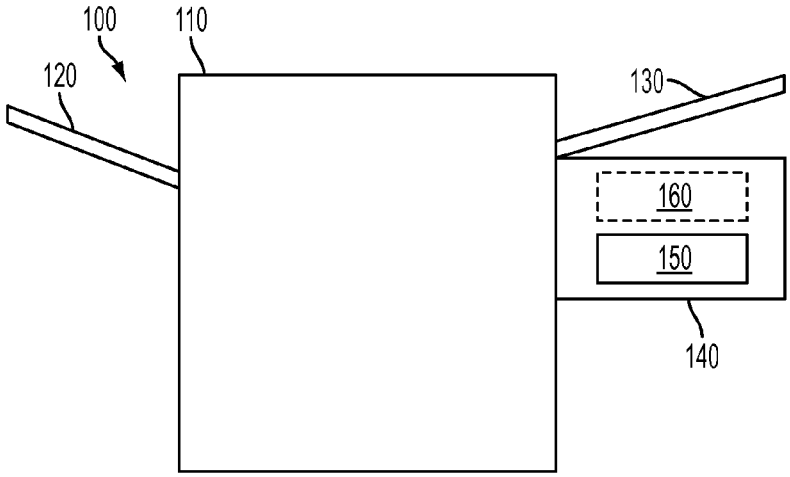
FIG. 1 illustrates a side view of an office-sized image forming device with an exemplary embodiment of a cooling and de-curling module according to this disclosure attached.
Figure 2:
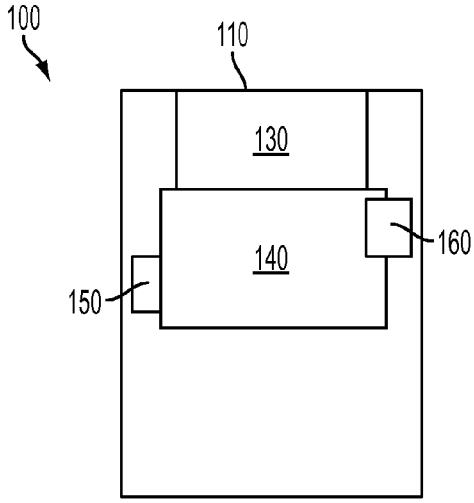
FIG. 2 illustrates an end view of an office-sized image forming device with an exemplary embodiment of a cooling and de-curling module according to this disclosure attached.

FIG. 1 illustrates a side view 100 of an office-sized image forming device 110 with an exemplary embodiment of a cooling and de-curling module 140 according to this disclosure attached. FIG. 2 illustrates an end view 100 of office-sized image forming device 110 with the exemplary embodiment of the cooling and de-curling module 140 according to this disclosure attached. A typical office-sized image forming device 110 may incorporate image receiving media substrate marking components and image fusing and finishing components (not shown). According to known methods, the typical office-sized image forming device 110 may accept input of varying types and constitutions of image receiving media at an image receiving media input tray 120. Alternatively, image receiving media of all types may be presented to the substrate marking components from one or more internal image receiving media substrate trays, often each of the plurality of image receiving media substrate trays being designated and adjustable to hold a particular type and constitution of image receiving media substrate. As is well known in the art, images formed on myriad constitutions of image receiving media substrates are then fused and fixed on those image receiving media substrates through a combined application of heat and pressure. The fusing, therefore, imparts a certain amount of heat to the image receiving media substrate prior to delivering any individual sheet of image receiving media substrate, with an image formed thereon, to a typically-configured OCT 130. In a typical configuration, the image receiving media input tray 120, typical office-sized image forming device 110, and OCT 130 combine to define a particular vertical physical footprint of an office-sized image forming system.

The systems and methods according to this disclosure introduce, substantially within the bounds of that particular vertical physical footprint defined for the office-sized image forming system, a cooling and de-curling module 140, internal details of which will be described in more detail below. The cooling and de-curling module 140 may include one or more integral and/or externally-mounted fans 150 with which cooling air may be introduced into an internal space of the cooling and de-curling module 140. Certain details of characteristic airflow introduced by the one or more fans 150, when present, will also be described in greater detail below. The cooling and de-curling module 140 may include one or more integral and/or externally-mounted motors 160 for driving the internal components of the cooling and de-curling module 140 to provide an image receiving media transport path for moving the image receiving media through the cooling and de-curling module 140.

In operation, individual sheets of image receiving media substrates may be picked up according to known means from an external image receiving media input tray 120, or otherwise from one or more internal image receiving media sources and presented to a marking module internal to the typical image forming device 110. The marking module of the image forming device 110 may receive imaging inputs from one or more imaging sources again according to known methods. The marking module may form images on individual sheets of image receiving media substrate as they are presented to a marking module via image receiving media transport paths. Individual sheets of image receiving media substrates, with the images formed thereon according to the imaging inputs received by the image forming device 110 may then be transported in a process direction farther along an image receiving media substrate flow path from the marking module to a fusing/finishing module. In the systems and methods according to this disclosure, instead of them being directly output to an OCT 130, the individual sheets of image receiving media substrates may be output along a supplemental flow path from an output of the image forming device 110 to an input of the cooling and de-curling module 140. The input to the cooling and de-curling module 140 may be selectable. In some embodiments, depending on a constitution of the image receiving media substrates on which the images are formed in the image forming device 110, a manual selection may be offered to a user, or an automated selection may be made, to direct image receiving media substrates, with images formed thereon, directly to the OCT 130 or separately through the cooling and de-curling module 140.

Figure 3:
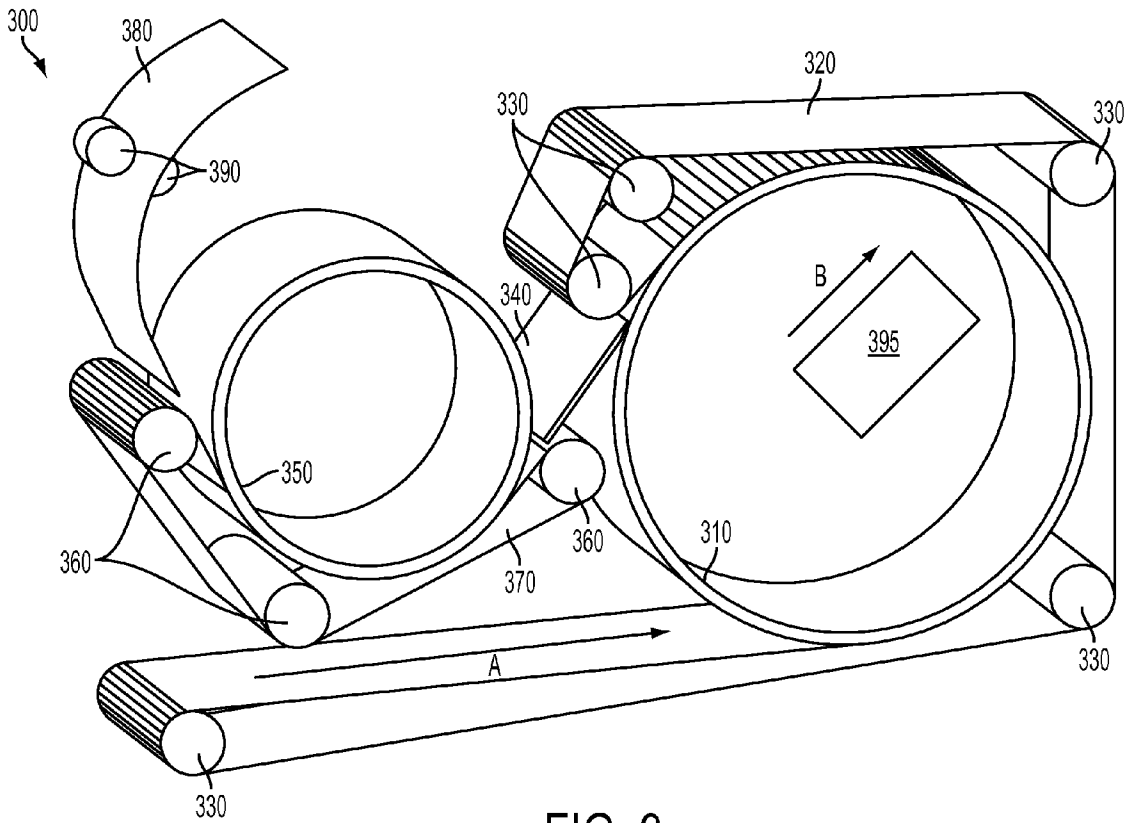
FIG. 3 illustrates an exemplary embodiment of internal details of a particularly-configured cooling and de-curling module according to this disclosure.

FIG. 3 illustrates an exemplary embodiment 300 of internal details of a particularly-configured cooling and de-curling module, such as the cooling and de-curling module 140 shown in FIG. 1 according to this disclosure. As shown in FIG. 3, an image receiving media flow path through the particularly-configured cooling and de-curling module may be configured in generally a horizontal "S" shape about two rotatable cooling drums 310, 350. Individual sheets of image receiving media substrate may exit an image forming device, such as image forming device 110 shown in FIG. 1, through a currently-configured exit port in the image forming device.

The individual sheets of image receiving media substrates may enter the cooling and de-curling module in a manner that allows them to be translated along an image receiving media substrate transport path that begins in a direction A on a first belt 320. The first belt 320 may be a woven belt that is threaded around a plurality of first idler rolls 330. The individual sheets of image receiving media substrates may be cooled by conduction as the individual sheets are pressed first between the first belt 320 and the first of a pair of rotating cooling drums, the first drum 310, curling the individual sheets in a first direction, while the individual sheets of image receiving media substrates are still comparatively hot and, therefore, more pliable.

The flow path may continue as the individual sheets are stripped from the first drum 310 by an intermediate baffle 340 and guided toward a second belt 370. The second belt 370 may be threaded around a plurality of second idler rolls 360. The individual sheets of image receiving media substrates may be cooled by conduction as the individual sheets are pressed then between the second belt 370 and the second of the pair of rotating cooling drums, the second drum 350, curling the individual sheets in a second direction, when the individual sheets of image receiving media substrates are comparatively cooler and less pliable. From there, the individual sheets may be directed, or otherwise stripped, away from the second roll 350 by final baffling 380 supported by one or more support rolls 390. The individual sheets may then be output to the OCT, which may be moved a slight distance away from the image forming device, and upward a small distance compared to a conventional location. As shown in FIG. 3, a preferable configuration of the cooling and de-curling module includes a first drum 310 having a larger diameter than a second drum 350. If there were no difference in the size of the first and second drums, the second drum may be ineffective in removing any residual curling imparted by the first drum while the substrate is still warm and then the substrate cools. That being stated, no particular limiting configuration to the individual sizes of the cooling drums is intended.

As indicated above, the pair of belts supported by the individual sets of idler rolls and in contact with the pair of rotating cooling drums present a general configuration of a paper path in the form of a horizontal "S" shape below an OCT.

The first drum 310 and the second drum 350 may be cooled by blowing air substantially transversely through, orthogonally to or axially down an axis of the first drum 310 and the second drum 350. The first drum 310 and/or the second drum 350 may alternatively be cooled by blowing air substantially radially toward an inside diameter of the first drum 310 or the second drum 350, using, for example, a cooling unit 395 that may force air in a direction B impinging on an interior of the first drum 310.

Figure 4:
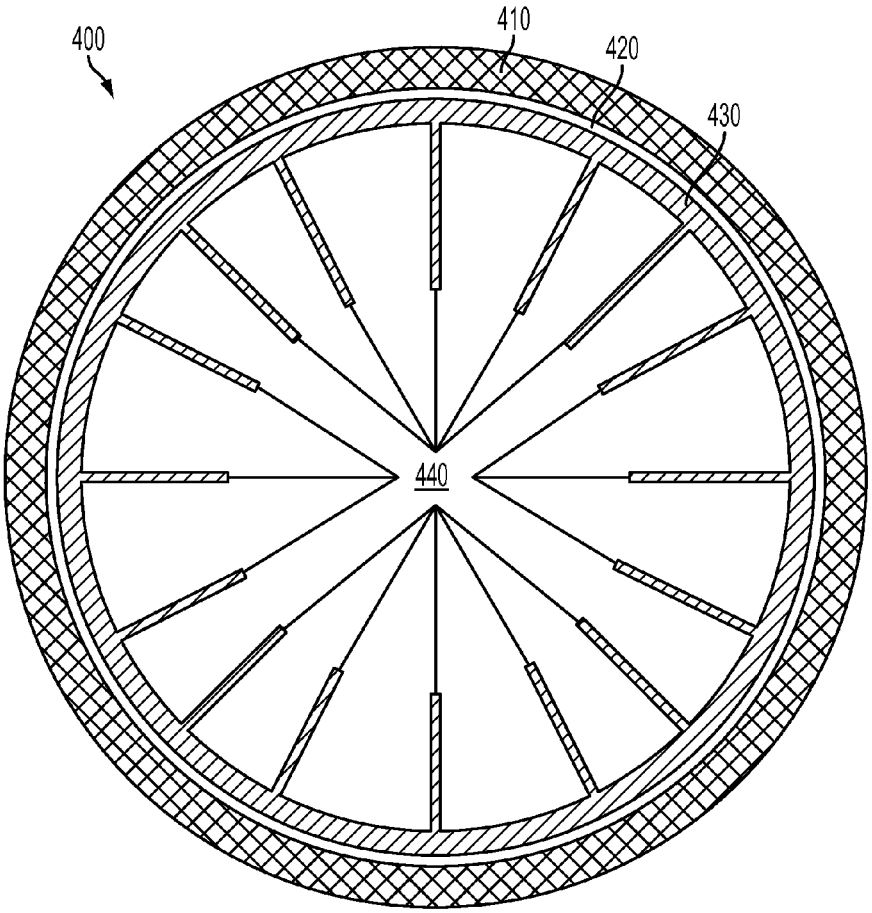
FIG. 4 illustrates an exemplary embodiment of details of one configuration for a rotating cooling drum for use in a cooling and de-curling module according to this disclosure.

FIG. 4 illustrates an exemplary embodiment of details of one configuration for a rotating cooling drum 400 for use in a cooling and de-curling module, such as the cooling and de-curling unit 140 shown in FIGS. 1 and 2. As shown in FIG. 4, the rotating cooling drum 400 may have an outer heat dissipating layer 410, an active Peltier cooling layer 420 and/or an inner heat sink layer 430. The active Peltier cooling layer 420 may include a plurality of solid state cooling components for carrying out thermoelectric cooling using a Peltier effect. The inner heat sink layer 430 may incorporate a plurality of heat sink protrusions 440 to aid in the heat dissipation to the convective flow of air across the interior of the rotating cooling drum 400. In embodiments, the disclosed rotating cooling drums may incorporate one, two or all three of these mechanisms to facilitate heat dissipation in the cooling and de-curling module on which the rotating cooling drums may be operated.

Figure 5:
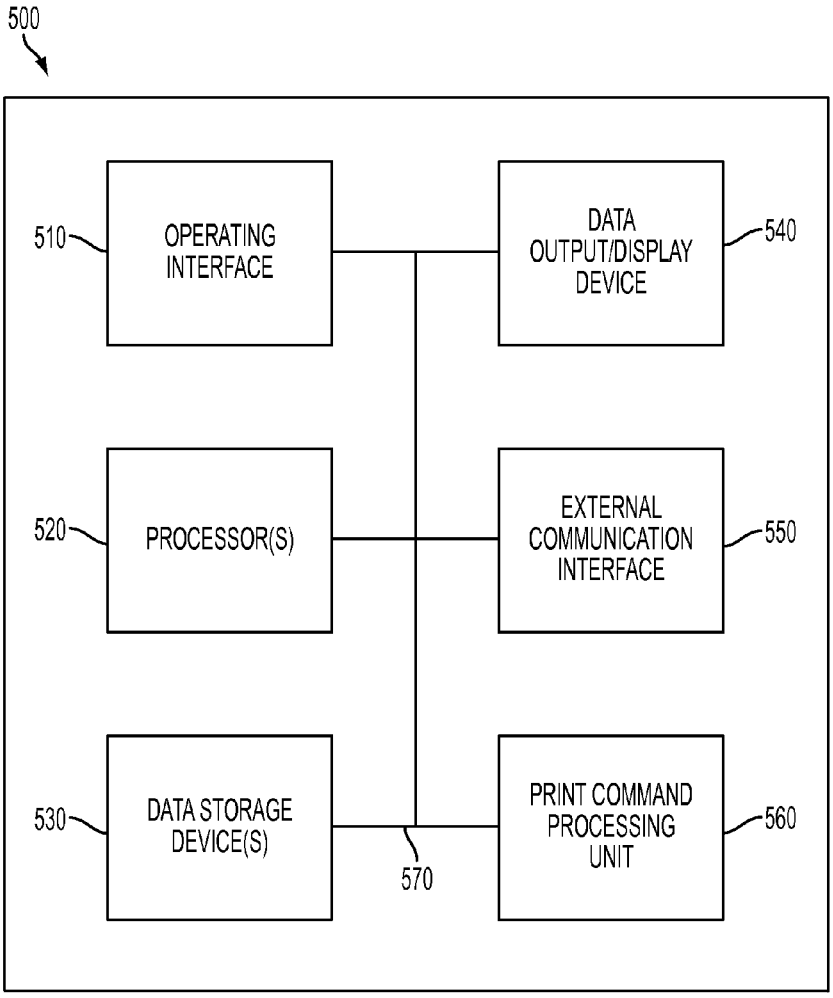
FIG. 5 illustrates a block diagram of an exemplary system for operating an image forming device with a particularly-configured cooling and de-curling module according to this disclosure.

FIG. 5 illustrates a block diagram of an exemplary system 500 for operating an image forming device with a particularly-configured cooling and de-curling module according to this disclosure. Components of the exemplary system 500 shown in FIG. 5 may be, for example, housed in a user workstation, in a server or in an image forming device.

The exemplary system 500 may include an operating interface 510 by which a user may communicate with the exemplary system 500, or otherwise by which the exemplary system 500 may receive instructions input to it from another source. In instances where the operating interface 510 may be a locally accessible user interface, the operating interface 510 may be configured as one or more conventional mechanisms common to computing and/or image forming devices that permit a user to input information to the exemplary system 500. The operating interface 510 may include, for example, a conventional keyboard and mouse, a touchscreen with "soft" buttons or with various components for use with a compatible stylus, a microphone by which a user may provide oral commands to the exemplary system 500 to be "translated" by a voice recognition program, or other like device by which a user may communicate specific operating instructions to the exemplary system 500.

The exemplary system 500 may include one or more local processors 520 for individually operating the exemplary system 500 and for carrying out processing, assessment, reporting and control functions. Processor(s) 520 may include at least one conventional processor or microprocessor that interprets and executes instructions to direct specific operation and analysis functions with regard to image data that is commanded or intended to direct image forming in a specific image forming device with which the exemplary system 500 is associated.

The exemplary system 500 may include one or more data storage devices 530. Such data storage device(s) 530 may be used to store data or operating programs to be used by the exemplary system 500, and specifically the processor(s) 520, in carrying out the image data forming functions of the exemplary system 500. Data storage device(s) 530 may be used to collect information regarding any or all of the functions of the exemplary system 500, as described above. The data storage device(s) 530 may include a random access memory (RAM) or another type of dynamic storage device that is capable of storing collected information, and separately storing instructions for execution of system operations by, for example, processor(s) 520. Data storage device(s) 530 may also include a read-only memory (ROM), which may include a conventional ROM device or another type of static storage device that stores static information and instructions for processor(s) 520. Further, the data storage device(s) 530 may be integral to the exemplary system 500, or may be provided external to, and in wired or wireless communication with, the exemplary system 500.

The exemplary system 500 may include at least one data output/display device 540, which may be configured as one or more conventional mechanisms that output information to a user, including a display screen on a computing or image forming device, including a graphical user interface (GUI) on the image forming device. The data output/display device 540 may be usable to display to a user an indication of image forming data, and a selection of image receiving media, that may be evaluated to indicate a control function for an airflow and/or processing speed to mitigate adverse effects of excess heat imparted to particular image receiving media substrates associated with particular image forming operations in an image forming device. The data output/display device 340 may then be usable, in conjunction with the operating interface 310 to display to a user a series of options for optimized image forming operations in the image forming device.

The exemplary system 500 may include one or more separate external communication interfaces 550 by which the exemplary system 500 may communicate with components external to the exemplary system 500, or by which the exemplary system 500 may communicate with an image forming device with which the exemplary system 500 may be associated when it is not fully integral to the image forming device. No particular limiting configuration to the external communication interface(s) 550 is to be implied by the depiction in FIG. 5, other than that the external communication interface(s) 550 may be configured to connect to external components via one or more available wired or wireless communication links.

The exemplary system 500 may include a print command processing unit 560, which may be a part or a function of processor 520 coupled to, for example, one or more storage devices 530, or may be a separate stand-alone component module or circuit in the exemplary system 500. The print command processing unit 560 may review control and image data that specify an image forming operation to be carried out by the image forming device. The print command processing unit 560 may then control the image forming operation in the image forming device according to the control and image data, and particularly control heat levels in one or more processed image receiving media substrates output from the image forming device. Additionally, the print command processing unit 560 may provide for an automated or manual selection of a flow of individual sheets of image receiving media substrates exiting the outlet of the image forming device with which the exemplary system 500 is associated. The flow of the individual sheets of image receiving media exiting the outlet of the image forming device may be, for example, selectable between flowing the individual sheets of image receiving media substrates through a cooling and de-curling module to an output catch tray associated with the cooling and de-curling module or flowing the individual sheets of image receiving media substrates so as to bypass the cooling and de-curling module and proceed directly to the output catch tray.

All of the various components of the exemplary system 500, as depicted in FIG. 5, may be connected by one or more data/control busses 570. These data/control busses 570 may provide wired or wireless communication between the various components of the exemplary system 500, whether all of those components are housed integrally in, or are otherwise external and connected to, the exemplary system 500.

It should be appreciated that, although depicted in FIG. 5 as what appears to be an integral unit, the various disclosed elements of the exemplary system 500 may be arranged in any combination of sub-systems as individual components or combinations of components, integral to a single unit, or external to, and in wired or wireless communication with the single unit of the exemplary system 500. In other words, no specific configuration as an integral unit or as a support unit is to be implied by the depiction in FIG. 5. Further, although depicted as individual units for ease of understanding of the details provided in this disclosure regarding the exemplary system 500, it should be understood that the described functions of any of the individually-depicted components may be undertaken, for example, by one or more processors 520 connected to, and in communication with, one or more data storage devices 530.

Figure 6:
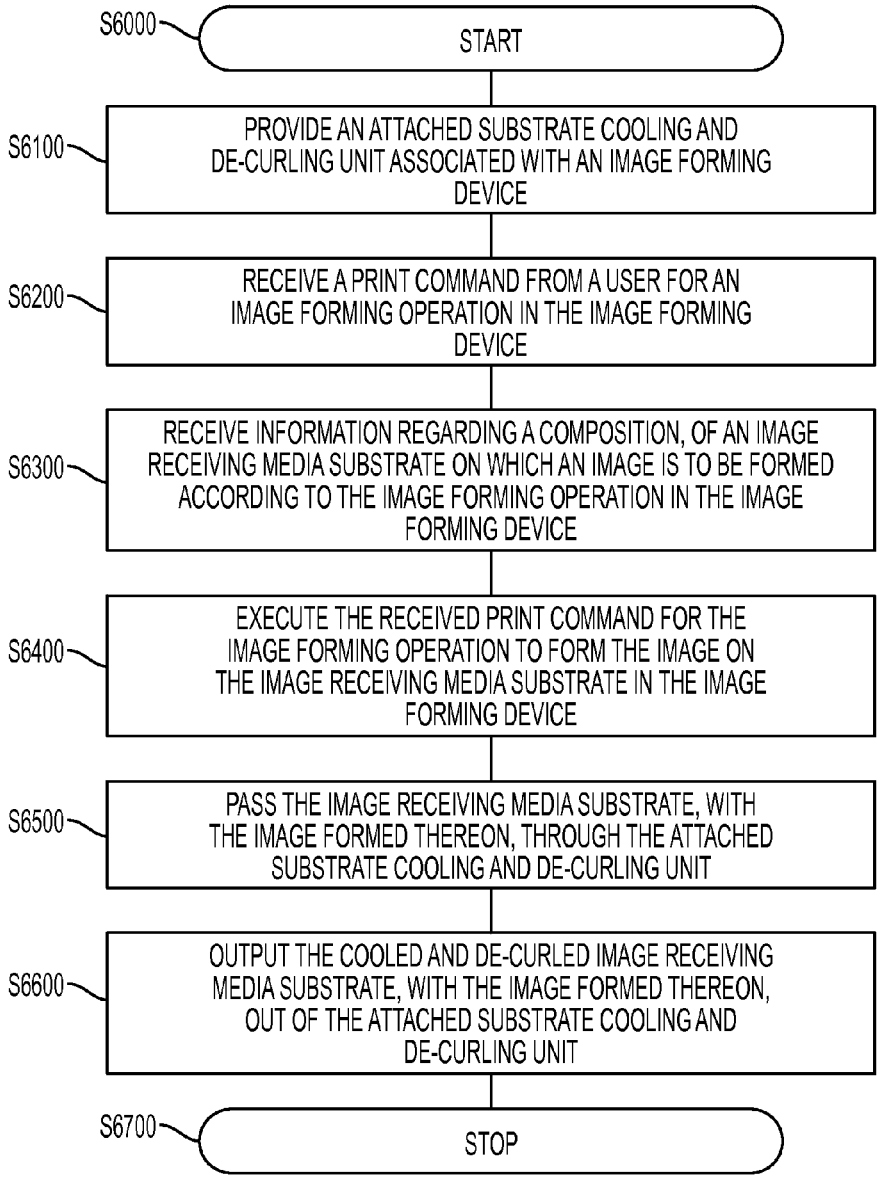
FIG. 6 illustrates a flowchart of an exemplary method for operating an image forming device with a particularly-configured cooling and de-curling module according to this disclosure.

The disclosed embodiments may include an exemplary method for operating an image forming device with a particularly-configured cooling and de-curling module. FIG. 6 illustrates a flowchart of such an exemplary method. As shown in FIG. 6, operation of the method commences at Step S6000 and proceeds to Step S6100.

In Step S6100, an attached substrate cooling and de-curling unit may be associated with an image forming device. The attached substrate cooling and de-curling unit: (1) may be particularly configured to maintain a substantially same vertical profile for the image forming device; (2) may be particularly configured to have a configuration of individual internal components as shown in FIG. 3; and/or (3) may be particularly configured to be retrofit onto a legacy office-sized image forming device. Operation of the method proceeds to Step S6200.

In Step S6200, a print command for an image forming operation in the image forming device may be received from a user. Operation of the method proceeds to Step S6300.

In Step S6300, information may be received regarding a composition of an image receiving media substrate on which an image is to be formed according to the image forming operation in the image forming device. Operation of the method proceeds to Step S6400.

In Step S6400, the received print command may be executed in the image forming device. Operation of the method proceeds to Step S6500.

In Step S6500, the image receiving media substrate, with the image formed thereon, may be passed through the attached substrate cooling and de-curling unit. All image receiving media substrates may be passed through the unit, or certain select sheets of the image receiving media substrates depending, for example, on a composition of the certain select sheets that causes them to retain heat longer may be selectively passed through the unit based on an automatic selection of an image receiving media substrate flow path through the unit, or on a manual selection thereof. Operation of the method proceeds to Step S6600.

In Step S6600, a cooled and de-curled image receiving media substrate may be output from the attached substrate cooling and de-curling unit. Operation of the method proceeds to Step S6700, where operation of the method ceases.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable print processing environments in which the subject matter of this disclosure may be implemented for familiarity and ease of understanding. Although not required, embodiments of the disclosure may be provided, at least in part, in a form of hardware circuits, firmware, or software computer-executable instructions to carry out the specific functions described. These may include individual program modules executed by a processor. Generally, program modules include routine programs, objects, components, data structures, and the like that perform particular tasks or implement particular data types in support of the overall objective of the systems and methods according to this disclosure.

Those skilled in the art will appreciate that other embodiments of the disclosed subject matter may be practiced in widely varying image forming environments with many types of office-sized image forming devices.

As indicated above, embodiments within the scope of this disclosure may also include computer-readable media having stored computer-executable instructions or data structures that can be accessed, read and executed by one or more processors. Such computer-readable media can be any available media that can be accessed by a processor, general purpose or special purpose computer. By way of example, and not limitation, such computer-readable media can comprise RAM, ROM, EEPROM, CD-ROM, flash drives, data memory cards or other analog or digital data storage device that can be used to carry or store desired program elements or steps in the form of accessible computer-executable instructions or data structures. When information is transferred or provided over a network or another communication connection, whether wired, wireless, or in some combination of the two, the receiving processor properly views the connection as a computer-readable medium. Thus, any such connection is properly termed a computer-readable medium. Combinations of the above should also be considered to be included within the scope of the computer-readable media for the purposes of this disclosure.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures represents one example of a corresponding sequence of acts for implementing the functions described in the steps. The exemplary depicted steps may be executed in any reasonable order to effect the objectives of the disclosed embodiments. No particular order to the disclosed steps of the method is necessarily implied by the depiction in FIG. 6, nor do all of the steps need to be performed, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure.

It will be appreciated that various of the above-disclosed and other features and functions, or alternatives thereof, may be desirably combined into many other different systems or applications. Also, various alternatives, modifications, variations or improvements therein may be subsequently made by those skilled in the art, which are also intended to be encompassed by the following claims.

We claim:

1. A substrate cooling unit for use with an image forming device, comprising:

a first cooling roll;

a first transport belt that is in contact with a portion of an outer surface of the first cooling roll to substantially sandwich individual sheets of image receiving media between the first cooling roll and the first transport belt with a first surface of the individual sheets of image receiving media facing the first roll;

a second cooling roll positioned downstream of the first cooling roll in a process direction;

a second transport belt that is in contact with a portion of an outer surface of the second cooling roll to substantially sandwich the individual sheets of image receiving media between the second cooling roll and the second transport belt with a second surface of the individual sheets of image receiving media facing the second roll; and an air source that introduces a cooling air flow to an inner surface of the first cooling roll and the second cooling roll;

wherein the first cooling roll having a larger diameter than the second cooling roll.

2. The substrate cooling unit of claim 1, the air source being positioned substantially orthogonally to a transport path comprising the first cooling roll, the first transport belt, the second cooling roll and the second transport belt and introducing the cooling air flow substantially axially through the first cooling roll and the second cooling roll.

3. The substrate cooling device of claim 1, the air source comprising a plurality of individual air sources being mounted internally to the first cooling roll and second cooling roll and introducing the cooling air flow substantially radially to impinge on an inner surface of the first cooling roll and the second cooling roll.

4. The substrate cooling unit of claim 1, further comprising an image receiving media inlet through which the individual sheets of image receiving media pass to be deposited on the first transport belt, the image receiving media inlet being aligned with an outlet of the image forming device.

5. The substrate cooling unit of claim 4, further comprising an image receiving media outlet through which the individual sheets of image receiving media pass after being processed through a transport path comprising the first cooling roll, the first transport belt, the second cooling roll and the second transport belt in the substrate cooling unit.

6. The substrate cooling unit of claim 5, further comprising an output catch tray into which the individual sheets of image receiving media are deposited when exiting the image receiving media outlet.

7. The substrate cooling unit of claim 6, further comprising a processor that provides a selection of a flow of the individual sheets of image receiving media exiting the outlet of the image forming device.

8. The substrate cooling unit of claim 7, the selection of the flow of the individual sheets of image receiving media exiting the outlet of the image forming device being one of through the substrate cooling unit to the output catch tray or bypassing the substrate cooling unit and proceeding directly to the output catch tray.

9. The substrate cooling unit of claim 8, the selection of the flow of the individual sheets of image receiving media exiting the outlet of the image forming device being based on a manual input received from a user via a user interface.

10. The substrate cooling unit of claim 8, the selection of the flow of the individual sheets of image receiving media exiting the outlet of the image forming device being based on an automated routine according to stored properties of the image receiving media.

11. The substrate cooling unit of claim 1, at least one of the first cooling roll and the second cooling roll comprising a heat dissipating surface.

12. The substrate cooling unit of claim 1, at least one of the first cooling roll and the second cooling roll comprising a Peltier cooling component.

13. The substrate cooling unit of claim 1, at least one of the first cooling roll and the second cooling roll including a plurality of heat sink components in the form of inwardly radially extending protrusions mounted to an internal surface of the at least one of the first cooling roll and the second cooling roll.

14. An image forming device, comprising:

a substrate cooling unit, comprising:

a first cooling roll;

a first transport belt that is in contact with a portion of an outer surface of the first cooling roll to substantially sandwich individual sheets of image receiving media between the first cooling roll and the first transport belt with a first surface of the individual sheets of image receiving media facing the first roll;

a second cooling roll positioned downstream of the first cooling roll in a process direction and having a diameter that is smaller than a diameter of the first cooling roll;

a second transport belt that is in contact with a portion of an outer surface of the second cooling roll to substantially sandwich the individual sheets of image receiving media between the second cooling roll and the second transport belt with a second surface of the individual sheets of image receiving media facing the second roll; and an air source that introduces a cooling air flow to an inner surface of the first cooling roll and the second cooling roll.

15. The image forming device of claim 14, the air source of the substrate cooling unit being positioned substantially orthogonally to a transport path comprising the first cooling roll, the first transport belt, the second cooling roll and the second transport belt and introducing the cooling air flow substantially axially through the first cooling roll and the second cooling roll.

16. The image forming device of claim 14, the air source of the substrate cooling unit comprising a plurality of individual air sources being mounted internally to the first cooling roll and second cooling roll and introducing the cooling air flow substantially radially to impinge on an inner surface of the first cooling roll and the second cooling roll.

17. The image forming device of claim 14, an image receiving media inlet for the substrate cooling unit being aligned with an outlet of the image forming device, an image receiving media outlet for the substrate cooling unit being positioned at an end of a transport path comprising the first cooling roll, the first transport belt, the second cooling roll and the second transport belt in a process direction, and an output catch tray being provided into which the individual sheets of image receiving media are deposited when exiting the image receiving media outlet, the image forming device further comprising a processor that provides a selection of a flow of the individual sheets of image receiving media exiting the outlet of the image forming device to one of through the substrate cooling unit to the output catch tray or bypassing the substrate cooling unit and proceeding directly to the output catch tray, the selection of the flow of the individual sheets of image receiving media exiting the outlet of the image forming device being based on one of (1) a manual input received from a user via a user interface, and (2) an automated routine according to stored properties of the image receiving media.

18. A method for cooling and de-curling individual sheets of image receiving media in an image forming device, comprising:

providing a substrate cooling unit with an image receiving media inlet for the substrate cooling unit being aligned with an outlet of the image forming device, the substrate cooling unit comprising:

a first cooling roll;

a first transport belt that is in contact with a portion of an outer surface of the first cooling roll to substantially sandwich individual sheets of image receiving media between the first cooling roll and the first transport belt with a first surface of the individual sheets of image receiving media facing the first roll;

a second cooling roll positioned downstream of the first cooling roll in a process direction and having a diameter that is smaller than a diameter of the first cooling roll;

a second transport belt that is in contact with a portion of an outer surface of the second cooling roll to substantially sandwich the individual sheets of image receiving media between the second cooling roll and the second transport belt with a second surface of the individual sheets of image receiving media facing the second roll; and an air source that introduces a cooling air flow to an inner surface of the first cooling roll and the second cooling roll, marking and fixing an image on an individual sheet of image receiving media according to a marking operation in the image forming device;

determining, with a processor, a need for cooling and de-curling of the individual sheet of image receiving media based at least on one of a composition of the individual sheet of image receiving media and characteristics of the marking operation; and passing the individual sheet of image receiving media to one of through the substrate cooling unit or bypassing the substrate cooling unit based on the determining.

* * * * *